United States Patent [19]

Fouilloy

[11] 4,195,222

[45] Mar. 25, 1980

[54] POWER-SUPPLY DEVICE FOR A MICROCHANNEL TUBE

[75] Inventor: Jean-Pierre Fouilloy, Velizy, France

[73] Assignee: U.S. Philips Corporation, New York, N.Y.

[21] Appl. No.: 888,838

[22] Filed: Mar. 22, 1978

[30] Foreign Application Priority Data

Mar. 24, 1977 [FR] France ..... 77 08802

[51] Int. Cl.[2] ..... H01J 39/12

[52] U.S. Cl. ..... 250/213 VT; 250/207; 250/214 AG

[58] Field of Search ..... 250/207, 213 R, 213 VT, 250/214 C, 214 AG; 313/94, 103 R, 103 CM, 105 R, 105 CM

[56] References Cited

U.S. PATENT DOCUMENTS

| | | | |
|---|---|---|---|
| 3,666,957 | 5/1972 | Wyess | 250/213 VT |
| 3,739,178 | 6/1973 | Chow | 250/207 |
| 3,816,744 | 6/1974 | Chow | 250/214 AG |

*Primary Examiner*—David C. Nelms

*Attorney, Agent, or Firm*—Thomas A. Briody; Jack E. Haken

[57] ABSTRACT

A power supply for a microchannel image tube. Microchannel plate voltage is controlled, to adjust tube gain, as an inverse function of screen current in an intermediate illumination range. In addition, the photocathode plate voltage is controlled as a function of screen current in a second illumination range. The said second illumination range including higher illumination values than said first range and the lowest illumination value in said second range is at least equal to the minimum illumination value in said first range.

12 Claims, 3 Drawing Figures

POWER-SUPPLY DEVICE FOR A MICROCHANNEL TUBE

The invention relates to a power-supply device for a microchannel tube comprising a screen, a microchannel plate and a photocathode, which device comprises a first oscillator which via a first voltage multiplier furnishes a substantially constant direct voltage between the output of the microchannel plate and the screen. The invention also relates to a microchannel tube employing such a power-supply device.

Microchannel tubes, whether they employ image inversion or double proximity focussing, are mainly used as image intensifiers. In this specific field of application they are advantageously used to replace the cascade of a plurality of simple image tubes, i.e. tubes not comprising a microchannel plate. The plate, which is situated between the photocathode and the screen of a microchannel tube, is a source of secondary electro emission, which depends both on the number of low-energy primary electrons issuing from the photocathode and the d.c. bias between the input and the output of the plate. Thus, in a single tube a gain of several thousands is obtained, which in particular enables night vision at very low levels of scene illumination. As the power supply of such a tube is controlled for the lowest illumination levels, the number of primary electrons at increasing illumination increases proportionally to said illumination, which means an increase of the photocathode current and the screen current and consequently of the screen brightness. These factors lead to accelerated tube wear, in particular owing to the increased ion bombardment of the photocathode (the wear of said cathode being substantially proportional to the number of electrons which it emits), and to a degradation of the quality of the image which is obtained, owing to excessive brightness.

In order to mitigate said drawbacks it is known in particular from U.S. Pat. No. 3,666,957, which describes a device of the type mentioned in the preamble, to introduce a current-limiting resistor in the photocathode supply circuit. Since very small photocathode currents are involved, this resistor has a value ranging from several GΩ to several tens of GΩ. On the other hand, it is known from the same U.S. Patent Specification to obtain an automatic reduction of the gain of microchannel plate by means of a negative-feedback loop which reduces the voltage across the plate when the screen current increases. However, when the illumination increases further, without increasing to such a level as to allow a satisfactory direct observation of the scene, these two steps appear to be inadequate and instability effects occur in the operation of the tube, followed by complete failure to operate correctly. It is to be noted that during operation the necessarily limited gain reduction range of the plate generally precedes the range in which the instability effect occurs, owing to an insufficient voltage supply to the photocathode. As a matter of fact, for this last-mentioned range, the voltage $V_1$ between the photocathode and the input of the channel plate, which is much smaller than the nominal value, has dropped to only a few volts. The instability range occurs at a voltage $V_1$ which is smaller than or equal to a threshold value of approximately 2 volts and manifests itself in "hunting" at a very low frequency, giving the image an aspect which is disagreeable to the eye. In order to avoid this drawback, it is known, specifically from U.S. Pat. No. 3,739,178, to include a diode in parallel in the photocathode circuit, which diode becomes conductive below a value of $V_1$ which is greater than said voltage threshold, so that $V_1$ is maintained at a value which is higher than the threshold voltage. In the range of increasing illumination corresponding to the range for which the diode is conductive, such a tube can nevertheless hardly be used because of the loss of resolution as a result of too low a voltage $V_1$.

The device in accordance with the invention enables a good resolution and screen brightness to be obtained, whose variation is imperceptible to the eye in a range of operation which extends from the lowest scene illumination levels to an illumination of the order of 10 lux up from which direct observation of the scene is possible, because of the fact that in the power supply device of the type mentioned in the first paragraph of the description said first oscillator also furnishes a substantially constant minimum direct voltage $V_{20}$ via a second multiplier between the input and the output of said plate, that said device moreover comprises at least a second oscillator which via a third multiplier which is included in series with said second multiplier furnishes a variable direct voltage $V_{21}$ superimposed on said minimum voltage, between the input and the output of the plate, said variable voltage being controlled by the average screen current and being a decreasing function of the last-mentioned current, which itself is an increasing function of the scene illumination, in a first range of scene illumination, the photocathode being energized by a voltage chopper which, at least for a certain range of scene illumination, supplies voltage pulses having a nominal voltage value and corresponding to an on/off ratio which is controlled by the average screen current and which is a decreasing function of said current in a second range of illumination, whose minimum value is at least equal to that of the first range and which corresponds to higher illumination levels, in such a way that doubling of said average screen current corresponds to a variation of several orders of magnitude of said on/off ratio at a variation of several orders of magnitude of the scene illumination, the repetition frequency of said pulses being always adapted so as to obtain a satisfactory observation by the eye, the on/off ratio of the duration of a chopper being defined as the ratio of the duration of a chopping pulse to the interval between the beginning of said pulse and the beginning of the next pulse.

A further object of the invention is to realize a microchannel tube with image inversion or double-proximity focussing incorporating such a power supply device, said tube being for example utilised in binoculars.

In an embodiment of the invention which requires the tube of two oscillators, the chopper supplies voltage pulses over the entire range of operation of the tube.

In another embodiment which requires the use of three oscillators, the chopper operates only above a predetermined minimum threshold of scene illumination and the photocathode is supplied with a direct voltage of nominal value below said threshold.

A third embodiment comprises a first oscillator, which furnishes a substantially constant direct voltage between the output of the plate and the screen via a first voltage multiplier and a substantially constant minimum direct voltage $V_{20}$ between the input and the output of said plate; via a second multiplier; a second oscillator followed by a sawtooth generator which in its turn is followed by a pulse generator; a chopper assembly for energizing the photocathode, which chopper is constituted by an electronic device; a third voltage multiplier; and a field-effect transistor whose base is controlled by said pulse generator.

The basic idea of the invention is to enable the use of a microchannel image intensifier tube, which is designed for operation at very low illumination levels, under optimum conditions in a range of higher illumination levels up to 10 lux and more, by the use of a concept which is contrary to the concepts normally used in this technology, i.e. by reducing the emission of electrons instead of reducing their multiplication. The chopper effect corresponds to an ultra-rapid periodic obturation of the photocathode.

The following embodiments are described with reference to the accompanying drawings, in which.

Figure 1:
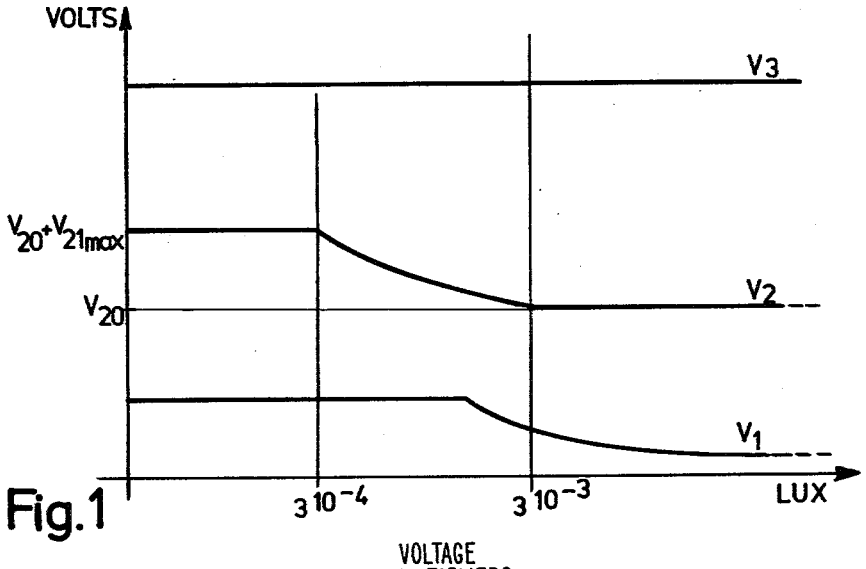
FIG. 1 represents the variation of the mean value of three supply voltages obtained in accordance with the invention, as a function of the scene illumination.

In FIG. 1, the voltage levels $V_1$, $V_2$ and $V_3$ obtained in accordance with the invention are not represented to scale. In the case of a double-focussing proximity tube, for example, the voltage $V_3$ applied between the output of the plate and the screen is of the order of 5000 volts, the voltage $V_2$ between the input and the output of the plate varies between values which are respectively of the order of 600 and 700 volts, and the voltage $V_1$, between the photocathode and the plate, has an average value which varies for example between 20 mV and 200 V.

On the horizontal axis, on which illumination values are given by way of indication, three adjacent zones can be distinguished starting from the lowest illumination level: a first zone in which the values of $V_1$, $V_2$ and $V_3$ are constant, a second zone in which the voltage $V_2$ decreases and a third zone in which the voltage $V_1$ decreases.

The voltage $V_3$ is a constant direct voltage. The direct voltage $V_2$ is initially equal to the sum of the voltages $V_{20}$ and $V_{21max}$, which last-mentioned voltages are both constant, and subsequently decreases to the value $V_{20}$ which it retains. The voltage $V_1$, is constant or equal to approximately 200 volts in a first range of illumination and may be either a direct voltage or a chopped voltage with a constant on-off ratio of approximately 1. In a second range of illumination $V_1$ is a chopped voltage with an on-off ratio which decreases to approximately zero, or an average voltage which varies from approximately 200 volts to a few tens of millivolts at an illumination level (not shown) of the order of 10 lux.

Figure 2:
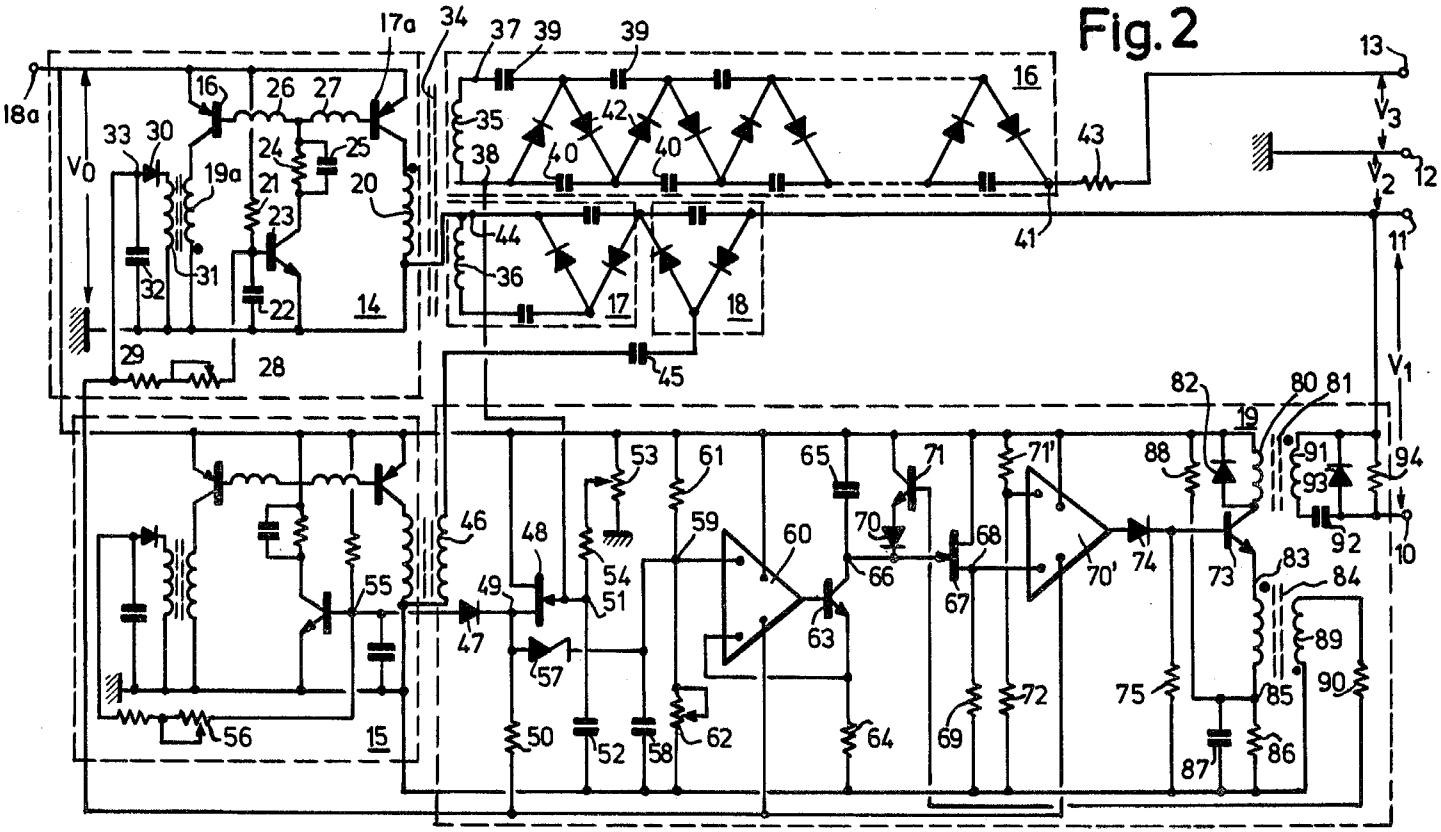
FIG. 2 is the detailed electronic diagram of an embodiment of the power supply device in accordance with the invention.

The electronic device shown in FIG. 2 is suitable for supplying a microchannel tube (not shown) comprising a screen, a microchannel plate and a photocathode. The values of the voltages on the terminals, taken in order of increasing value, are as follows: the supply voltage $V_1$ between the photocathode and the input of the plate is applied across the terminals 10 and 11, the supply voltage $V_2$ across the input and the output of the channel plate is applied across the terminals 11 and 12, and the supply voltage $V_3$ across the output of the plate and the screen is applied across the terminals 12 and 13, the terminal 12 being preferably at earth potential. This device comprises two oscillators, 14 and 15, operating in accordance with the same principle, three voltage multipliers 16, 17 and 18, and a chopper 19.

The oscillators 14 and 15 are of a known type which is referred to as balanced oscillator. By way of example the design and operation of the oscillator 14 is briefly described hereinafter.

The oscillator 14 comprises two PNP transistors 16 and **17*a* which operate as amplifiers in push-pull when the oscillation mode is started. The emitters of the two transistors are connected to a terminal 18*a* which serves for the application of a positive direct supply voltage $V_0$ having a value of for example 10 volts. The collectors of the transistors 16 and 17 are connected to earth, each via primary transformer windings, designated 19*a* and 20*d* respectively. The resistor 21 which is connected to the terminal 18 and to earth via a capacitor 22 serves to start the oscillator by biassing the base of an NPN-transistor 23 to voltage higher than 0.6 V. The emitter of the transistor 23 is connected to earth and its collector to the bases of the transistors 16 and 17*a* via a resistor 24 and a capacitor 25 which is connected in parallel with said resistor, and via an inductance 26 and an inductance 27** respectively.

A variable resistor 28, a resistor 29, a diode 30 and a secondary winding 31 of a transformer in which winding 19 constitutes the primary, are connected in series between the base of the transistor 23 and earth. A capacitor 32 connects the anode 33 of the diode 30 to earth. This part of the circuit 28 to 32 serves to bias the base of the transistor 23 by means of a negative-feedback effect to such a value that during operation the a.c. signals transferred by the transistors 16 and 17 are not limited to the voltage $V_0$ in the windings **19*a* and 20. Thus, by adjustment of the value of the resistor 28 it is ensured that said a.c. signals have a substantially sinusoidal shape and can be adjusted to a desired peak value smaller than $V_0$. In this respect it is to be noted that for negative feedback during operation, the voltage on point 33 is negative and in a first approximation is a direct voltage. When the voltage $V_o$ is applied to the terminal 18** the least parasitic transient effect suffices to start the oscillator.

The winding 20 provides the a.c. supply to two secondary windings 35 and 36 via the transformer 34, which are respectively connected to the terminals of the voltage multipliers 16 and 17 which are of known type, for example voltage multipliers of the constant-current type.

Such a multiplier, for example the multiplier 16, comprises capacitors such as 39 connected in series with the terminal 37, and capacitors such as 40 connected in series between the terminals 38 and 41. Series-connected diodes such as 42 connect the terminal 38 to the terminal 41 in such a way that starting from the terminal 38 each capacitor, except that which is connected to the terminal 37, is included, between the anode of a diode and the cathode of the diode which is adjacent to the first-mentioned diode and connected in series therewith. The capacitors 39 and 40 may have equal capacitances, their charging voltage being equal to twice the peak voltage of the signal generated in the winding 35. This multiplier operates by successive charge transfer in such a way that the desired high voltage is available across the terminals 41 and 38, the basic voltages across the capacitors 40 being substantially equal to each other and being added to each other. For example, for a voltage of $V_o$ of 10 volts, a peak value of the signal in winding 20 of 6 V, a peak value of the signal in the winding 35 of 300 V, i.e. a transformation ratio of 50 for the transformer 34, a voltage of 600 V (peak to peak voltage) appears across each capacitor 40 and since there are 8 capacitors 40, the voltage across the terminals 38 and 41 is 4800 V.

The terminal 38 is biassed to a potential which is variable between 5 V and approximately −8 V as will be seen hereinafter, so that the voltage $V_3$ between the output of the microchannel plate, which is connected to earth, and the screen is approximately 4800 V. The current limiting resistor 43 has a value of for example 10 MΩ. The voltage $V_3$ remains substantially constant as a function of the scene illumination.

The multiplier 17 is also of the constant current type, the polarities being the inverse of those of the multiplier 16. This multiplier serves to bias the input of the plate to a voltage which is necessarily negative, because the output of the plate has been connected to earth.

This multiplier, which is connected to the terminals of the winding 36, of which terminal 44 is connected to earth, supplies a minimum direct voltage $V_{20}$ to the microchannel plate.

The oscillator 15, serves to provide a complementary power supply for the microchannel plate and to energize the photocathode. In order to obtain this complementary power supply, a third multiplier 18 which is of the same type as the multiplier 17, with which it is connected in series, and is decoupled by the capacitor 45, is energized by the winding 46 which is a secondary winding of the transformer and is connected at one of its ends to earth. This complementary direct voltage $V_{21}$, which is initially constant for the lowest range of scene illumination, decreases to zero value for a medium range of illumination which is centred about a value of the order of $10^{-3}$ lux and remains zero beyond this. The value of the voltage $V_2$ satisfies the formula: $V_2=V_{20}+V_{21}$ (see FIG. 1).

The design of the oscillator 15 is the same as that of the oscillator 14. Its operation is also the same as long as the diode 47 is not conductive, during which mode of operation $V_{21}$ and consequently $V_2$ have a constant maximum value in the lowest range of illumination.

The chopper 19 comprises a field-effect transistor 48 whose source receives the voltage $V_0$ and whose drain 49 is connected to the cathode of the diode 47 and to the negative-voltage point 33 via a resistor 50. The gate 51 of this transistor is connected to the terminal 38, to earth via a capacitor 52, and to the wiper of a potentiometer 53 via a resistor 54. The potentiometer 53 is connected between the voltage source $V_0$ and earth. The screen current is returned via earth, the component 53 and 54, and the terminal 38 which is connected to point 51. The capacitor 52 serves to filter out ripple, which is caused by the intermittent operation of the tube because of the pulsed supply of the photocathode, in such a way that the voltage at point 51 is in a first approximation a direct voltage and is thus representative of the average screen current. When this current increases owing to an increasing scene illumination, the voltage on point 51, and consequently that on point 49, decreases the gain of transistor 48 being unity. When the potential on point 49 becomes equal to that on the base 55 of the oscillator driver transistor 15 minus 0.6 V, diode 47 becomes conductive via the resistor 50. As a result the voltage on point 55 is reduced and thus the gain of the microchannel plate is reduced (via the oscillator 15 and the multiplier 18) and the screen current is describes owing to the depletion of secondary electrons emitted through the plate. Thus, a closed-loop effect is obtained, which manifests itself in a progressive reduction of the signal supplied by the oscillator 15, which reduction is a function of the scene illumination, i.e. of the primary electrons emitted by the photocathode and received at the input of the plate. The relevant range of illumination through this special mode of operation of the oscillator 15, which continues until said oscillator is stopped, is effected by adjustment of the wiper of the variable resistor 56 and subsequently the wiper of the potentiometer 53.

The part of the chopper 19 employed for the power supply of the photocathode is also controlled by the variation of the voltage at point 49. It comprises a Zener diode 57 whose anode is connected to the drain 49 of transistor 48 and whose cathode is connected to one electrode of a capacitor 58 (the other electrode of which is connected to earth) and to the positive input 59 of a differential amplifier 60. This input is biassed by the resistor 61, which is connected to the source of the voltage $V_0$, and by the variable resistor 62, which is connected to earth. The drop of the potential on point 51 is transferred to point 59 via the Zener diode 57. The differential amplifier 60 is powered, between the positive source $V_O$ and point 33, which serves as negative source. The output of amplifier 60 is connected to the base of an NPN transistor 63 whose emitter is connected to the negative input of amplifier 60 and to earth via a resistor 64. The collector of the transistor 63 is connected to the source $V_0$ via a capacitor 65. This part (59 to 65) of the device constitutes a generator which produces a current of constant instantaneous value. The differential amplifier 60 has unity voltage gain and the emitter voltage of the transistor 63 thus follows the voltage on point 59 with a value which is 0.5 V smaller. The current gain of transistor 63 is defined by its base voltage and the value of the resistor 64, the collector and emitter currents being in a first approximation proportional to the voltage on point 59. The capacitor 65 is charged with a constant current, i.e. linearly. The adjustment (effected with the aid of the variable resistor 62) is, for example, such that for doubling the average screen current the voltage on point 59 changes from 7 V to 0.5065 V as a result of increased illumination, while the corresponding voltages on the emitter of the transistor change from 6.5 V to 6.5 mV, which results in a variation, of the charging current of the capacitor 65, by a factor of 1000 for example from 10 mA to 10 μA, which ratio may even increase to 10,000 owing to the precision ensured by the negative feedback through the connection 38–51. The function of the capacitor 65 is to produce an asymmetrical sawtooth voltage of constant amplitude and having a duration inversely proportional to the charging current, the end of each sawtooth coinciding with the generation of a voltage pulse of predetermined amplitude and duration for the power supply of the photocathode. This function is realized by the part of the chopper 19 described hereinbefore. The collector 66 of the transistor 63 is connected to the gate of a field-effect transistor 67 whose source is connected to the voltage source $V_0$ and whose drain 68 is connected to earth via a resistor 69.

Point 66 is also connected to the voltage source $V_0$ via the cathode and the anode of a diode 70, and the emitter and collector of NPN transistor 71. The drain 68 is connected to the negative input of a differential amplifier 70' which is energized by the same positive and negative sources which energize the amplifier 60, whose positive input is biassed to a positive voltage value by means of two resistors 71' and 72 which are respectively connected to the voltage source $V_0$ and to earth, and whose output is connected to the base of an NPN transistor 73 via diode 74.

The base of the transistor 73 is connected to earth via a resistor 75. A primary winding 80 of a transformer 81 is included between the voltage source $V_0$ and the collector of the transistor 73, which collector is also connected to the voltage source $V_0$ via the anode and the cathode of a diode 82. The emitter of the transistor 73 is connected to earth via a primary winding 83 of a transformer 84 which is connected in series with point 85 via a resistor 86. Point 85 is connected to earth via a capacitor 87 and to the voltage source $V_0$ via a resistor 88. A winding 89, which constitutes the secondary of the transformer 84, is connected to earth with one end and to the base of the transistor 71 via a resistor 90 with its other end.

When the voltage on point 66 decreases below a predetermined value during charging of the capacitor 65, the decreasing voltage is transferred to the drain 68 of the transistor 67 and the voltage at the positive input of the differential amplifier 70' becomes higher than that on the negative input, which suddenly gives rise to a positive voltage on the output of said amplifier. The diode 74 then becomes conductive, the transistor 73, which is operated in the on-off mode, is turned on and a signal is produced in the windings 80 and 83. The part which comprises the components 73, 80, 82, 83, 86, 87, 88 constituting a blocking oscillator of known type with emitter-collector feedback. This signal, which is transferred to the winding 89 by the transformer 84, turns on transistor 71 which operates in the on-off mode and the capacitor 65 suddenly discharges through the loop 65, 71, 70, 66. In this respect the diode 70 serves to minimize the undesired effect of the parasitic collector-emitter capacitance of the transistor 71, owing to its very low capacitance. This discharge causes transistor 73 to be turned off via the circuit 66, 67, 68, 70', 74 and the cycle starts again. The signal produced in the windings 80 and 83 is a pulse signal. Owing to the presence of the diode 82 the winding 80 transfers a well-defined pulse to a secondary winding 91 via the transformer 81. Thus, a well-defined variation of the pulse frequency is obtained by means of a control current in the circuit 65, 66, 63, 64, which is a proportional variation (i.e. the pulse frequency varying in a ratio of 1000 to 10,000) for a variation in scene illumination which varies with a ratio of 1000 to 10,000, which manifests itself in doubling or tripling of the average screen current during said variation. For example, the total variation of the average screen current in the range of operation where the on-off ratio of the chopper decreases, lies between 25 nA and 65 nA. Such a variation is entirely permissible in respect of aging of the tube and is imperceptible to the eye. For example, the range of illumination considered above begins at $2.10^{-3}$ lux and ends at 10 lux. One terminal of the winding 91 is connected to an electrode of a capacitor 92, whose other electrode is connected to the terminal 10 to which the photocathode is connected, to the anode of a diode 93 and to one end of a resistor 94. The other terminal of this winding is connected to the input terminal 11 of the micro-channel plate, to the cathode of the diode 93 and the other end of the resistor 94, which serves to provide a nominal predetermined photocathode voltage with respect to the input of the plate during each pulse. The components 92 and 93 serve for pulse-shaping on the secondary side of the transformer 81.

The duration of the pulse through the resistor 94 is determined by the RC time constant of the combination formed by said resistor and the stray capacitance of the photocathode, which is for example 30 pF.

If a minimum pulse frequency of for example 50 Hz is derived in order to ensure satisfactory observation by the eye, the maximum frequency in the lowest range of illumination, i.e. that for which there is no interaction between the average screen current and the chopper frequency, is approximately $10^5$ Hz, which is compatible with a pulse duration ranging from 1 $\mu$s to 3 or 4 $\mu$s, which has no adverse effect on observation.

In a preferred embodiment the chopper operates continuously, independently of the scene illumination, first (at lowest illumination levels) with a fixed predetermined pulse duration and on-off ratio and subsequently (at highest illumination levels) with a fixed pulse duration equal to the preceding value and an on-off ratio which decreases as an inverse function of the illumination, by the progressive prolongation of the interval between two adjacent pulses (from a few microseconds to some hundredths of a second). Such a chopper operation at low illumination levels is at the expense of a reduction of the brightness of the screen in comparison with that of a screen of a micro-channel tube whose cathode is supplied with a nominal direct voltage. This can simply be remedied in that in the device in accordance with the invention the voltage between the input and the output of the channel plate is adjusted so as to compensate for said loss of brightness, by increasing the gain of the plate in inverse proportion. In all cases the on-off ratio in this range of low illumination levels can approach the maximum value 1 and thus has hardly any adverse effect.

As an example, the values and designations of the components in FIG. 2 may be as follows.

16–2 N 2907
21–10 kΩ
23–2 N 2222
24–1 kΩ
28–10 kΩ
29–4.7 kΩ
32–1 $\mu$F
39–330 pF
40–330 pF
43–10 MΩ
50–100 kΩ
52–10 nF
53–1 MΩ
54–200 MΩ
61–330 kΩ
62–1 MΩ
63–2 N 2484
64–680 Ω
65–5000 pF
71'–220 kΩ
72–220 kΩ
75–47 kΩ
86–1 kΩ
88–4.7 kΩ
90–1 kΩ
92–330 pF
94–22 kΩ

Figure 3:
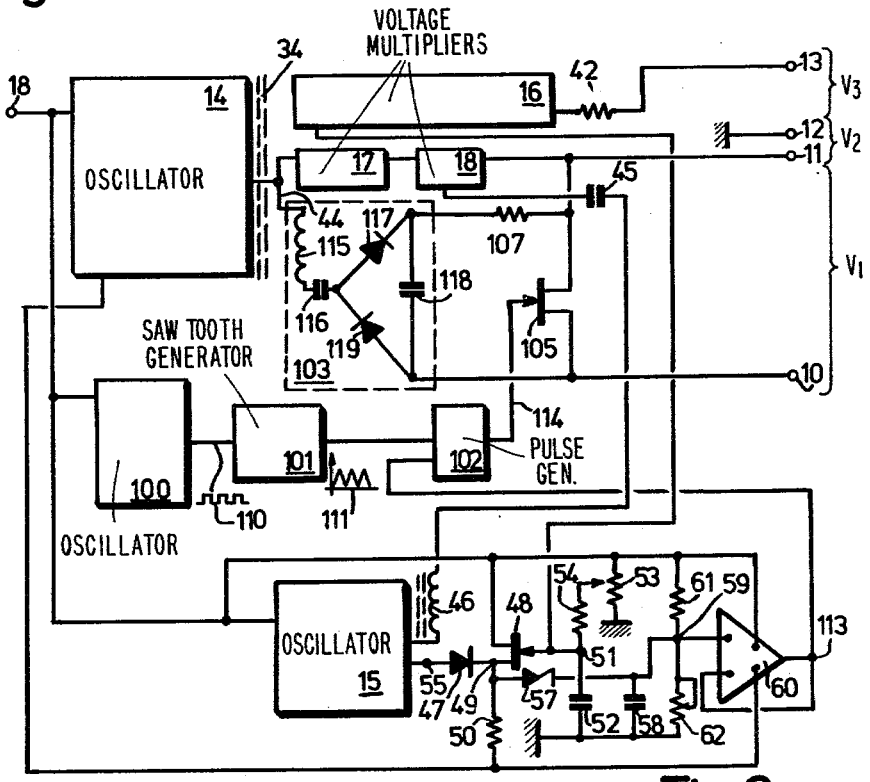
FIG. 3 is the electronic diagram of a second embodiment of the power supply device in accordance with the invention.

In a second embodiment of the power-supply device in accordance with the invention, referring to FIG. 3, the supply voltage of the photocathode is a direct voltage at low illumination levels. In said Figure, in which corresponding elements bear the same reference numerals as in FIG. 2. The supply voltage for the screen and the microchannel plate is obtained in the same way as in the previously described embodiment. In this case a third oscillator 100, a sawtooth generator 101 and a pulse generator 102 are connected in cascade together with a fourth voltage multiplier 103, a field-effect transistor 105 and a resistor 107 a power supply of the photocathode.

The oscillator 100, which is supplied with the voltage $V_0$, is a clock pulse generator of known type, which serves to produce a square wave signal of well defined amplitude and a predetermined constant frequency at the output. This frequency is preferably such as to allow a satisfactory observation by the eye, for example 100 Hz. This signal, which is schematically indicated by the reference numeral 110 in FIG. 3, is applied to a sawtooth generator of known type, which supplies a positive symmetrical sawtooth-shaped voltage signal, designated 111, with the same frequency as the pulses of the signal 110. The signal 111 is applied to a first input of a pulse generator 102, which also receives a positive direct voltage signal at a second input, which voltage varies from a value greater than the highest value of the signal 111 to a value smaller than the smallest value of the signal 111 at increasing level of scene illumination. The differential amplifier 60, which supplies a variable direct voltage, is connected as an inverter with unity gain. For this purpose, it receives the variable positive voltage signal from the cathode of the Zener diode 57 at its positive input 59, and its output 113 is directly connected to its negative input. In known manner the pulse generator 120 feeds a square-wave voltage signal into the conductor 114, which signal has a predetermined nominal voltage value and a frequency equal to that of the signals 111. The rising edge of each pulse coincides with the intersection of the voltage level received on the second input of the generator 102 and the rising edge of each sawtooth, while the falling edge of each pulse coincides with the intersection of said voltage level and the falling edge of each sawtooth. During each pulse on the conductor 114 the transistor 105 is conductive and the voltage $V_1$ is substantially zero. Inversely, in the absence of a pulse on the conductor 114, the transistor 105 is cut off and the voltage $V_1$ has a nominal value, for example 200 V. This range of operation of the tube corresponds to an intermediate range of illumination levels similar or identical to that described with reference to FIG. 2. For example, by means of the previously described adjustments and the adjustments of the circuits 100, 101 and 102, at increasing illumination levels, this range begins at an illumination level of the order of $3.10^{-3}$ lux at which the oscillator 15 stops or is about to stop in a similar way as in the case of FIG. 2, while said range ends at illumination levels of the order of 10 lux from which value satisfactory direct observation by the eye is possible. For this same range of illumination, the voltage on point 113 varies, for example, from 6.5 V to 6.5 mV, which values are the maximum and the minimum voltage of the signal 111 respectively. For illumination levels below a value of the order of $3.10^{-3}$ lux, the direct voltage on point 113 is higher than the maximum value of the signal 111, which manifests itself by the absence of chopping of the supply voltage of the photocathode, i.e. continuous operation of the tube, similar to that of a prior-art tube.

In accordance with said second embodiment of the invention, the photocathode supply is realized by means of the multiplier 103, FIG. 3, which is energized from a third secondary winding 115 of the transformer 34, of which one end is connected to point 44 which is at earth potential and the other end of which is connected to an electrode of a capacitor 116. Said multiplier preferably comprises a single cell, the other electrode of the capacitor 116 being connected to the first electrode of the capacitor 118 and to one end of the resistor 107 via the anode and the cathode of a diode 117, and via the cathode and the anode of a diode 119 to the second electrode of the capacitor 118, to the drain of the transistor 105 and to the terminal 10, which in its turn is connected to the photocathode, not shown. The other end of the resistor 107 is connected to the source of the transistor 105 and to the input terminal 11 of the microchannel plate. The output 114 of the pulse generator 102 is connected to the gate of transistor 105. The capacitor 118 is proportioned so that it produces the nominal photocathode supply voltage on its terminals, which condition determines the design and dimensioning of the multiplier 103. In the absence of a pulse on the conductor 114, the transistor 105 is cut off, and the photocathode receives its nominal voltage. During a pulse, transistor 105 is conductive and short-circuits the photocathode to the input of the microchannel plate. The resistor 107 serves to limit the discharge of the capacitor through the transistor 105 during the periods that said transistor is conductive, i.e. for the duration of each pulse, which function is critical in particular when chopping is started. This implies a minimum value for the resistor 107, whose maximum value is determined by the time constant which it defines in conjunction with the parasitic capacitance between the photocathode and the input of the channel plate, which is the time constant with which the nominal voltage between the terminal 10 and 11 is built up or suppressed. It is to be noted that irrespective of the value of said resistor as well as the resistor 94 in FIG. 2, its value is always several orders of magnitude smaller than that of the resistor which is necessarily included in series in the return circuit for the photocathode current in a prior-art tube with continuous power supply.

In the chopping zone, in accordance with said second embodiment, a variable on-off ratio of the chopper is thus obtained by varying the duration of the chopping pulses whose frequency, which is preferably such as to enable a satisfactory observation by the eye, remains constant.

It is obvious that other known electronic devices, equivalent to those described in detail hereinbefore, enable a chopped power supply of the photocathode of a microchannel tube to be obtained, the two previously described embodiments being given merely by way of example.

It is to be noted that in the two previously described embodiments the two illumination ranges, for which on the one hand the voltage $V_2$ across the input and the output of the channel plate varies and on the other hand the voltage $V_1$ across the photocathode and the input of the channel plate is chopped, are partly separated. This degree of freedom, which is useful for the adjustments for an optimal operation of the tube, results from the fact that in the two embodiments the element which generates the voltage $V_1$, i.e. the winding 91 (FIG. 2) and the capacitor 118 (FIG. 3) are respectively connected to the input of the microchannel plate with their least negative terminal. The only limitation imposed in respect of the voltages $V_1$ and $V_2$ is that the point where $V_2$ starts to decrease corresponds to an illumination level which is lower than or equal to the level which corresponds to the point where chopping of the voltage $V_1$ begins (see FIG. 1). In accordance with a variant, not shown, of said second embodiment the third multiplier 18 is dispensed with and the additional voltage $V_{21}$ is derived from the chopped photocathode voltage after transformation, rectification and smoothing, so that only two oscillators (14 and 100) need be used. In such a case, chopping takes places continuously, the on-off ratio being constant for the range of the lowest illumination levels.

For specific applications of the tube in accordance with the invention, for which the observation is anticipated of a scene in which very rapid variations of the illumination level are likely to occur, the power supply circuit in accordance with the invention should have a very small response time and are designed and adjusted accordingly. In addition to this step, it is possible in such cases, in accordance with the invention, to include a protection device of a known type against overexposure, which very rapidly renders the tube inoperative.

Such a power supply is preferably used for the power supply of a double-focussing proximity tube, the tube itself being employed for the observation of a scene by means of binoculars. However, the invention is not limited to such an application, where the tube thus energized may for example also be an image-inversion tube. In this last-mentioned case an adaptation of the power supply device in accordance with the invention is necessary because of the higher supply voltages. Similarly, the tube may be a fast tube having a low-resistance photocathode.

What is claimed is:

1. A power supply for a microchannel tube of the type which includes a screen, a microchannel plate having an input and an output, and a photocathode comprising:

first means for providing a substantially constant direct voltage between the output of the microchannel plate and the screen;

second means for providing a substantially constant direct plate voltage between the input of the microchannel plate and the output of the microchannel plate;

third means for superimposing a variable direct voltage on said direct plate voltage and for controlling said variable direct voltage as an inverse function of the average current flowing to the screen when a first range of illumination is incident on said tube; and fourth means for providing a photocathode voltage between said photocathode and said input of said microchannel plate and for controlling said photocathode voltage as an inverse function of said average current flowing to the screen when a second range of illumination is incident on said tube;

said second range of illumination including higher illumination levels than said first range, the lowest illumination level in said second range being at least as high as the lowest illumination level in said first range.

2. A power supply as claimed in claim 1 wherein the highest illumination level in the first range is substantially equal to the lowest illumination level in the second range.

3. A power supply as claimed in claim 1 wherein the lowest illumination level in the first range is substantially equal to the lowest illumination level in the second range.

4. A power supply as claimed in claim 1 wherein:

said first means comprises a first oscillator connected to the input of a first voltage multiplier;

said second means comprise a second voltage multiplier having an input connected to said first oscillator;

said third means comprise a second oscillator connected to the input of a third voltage multiplier which is connected in series with said first voltage multiplier; and said fourth means comprise a chopper which generates voltage pulses having a nominal value equal to said photocathode voltage in response to said average screen current.

5. A power-supply device as claimed in claim 4 wherein said chopper operates with a constant duty cycle of approximately unity, above the first range of illumination.

6. A power-supply device as claimed in claim 4 wherein said voltage pulses have a constant duration.

7. A power supply device as claimed in claim 4 wherein said fourth means comprise a chopper including:

a fourth voltage multiplier having an input connected to said first oscillator and an output connected to produce a voltage between said input of said microchannel plate and said photocathode;

a field effect transistor having a source and a drain connected between said input of said microchannel plate and said photocathode; and a third oscillator, a sawtooth generator and a pulse generator connected in cascade to the gate of said field effect transistor.

8. A power supply device as claimed in claim 7 wherein said chopper supplies pulses of constant frequency.

9. A power supply device as claimed in claim 7, characterized in that above the first range of illumination, said chopper supplies a constant nominal voltage.

10. A power-supply device as claimed in claim 9 wherein said chopper supplies voltage pulses of constant frequency.

11. A power supply device for a microchannel tube of the type which includes a screen, a microchannel plate having an input and an output, and a photocathode, comprising:

a first oscillator;

first voltage multiplier means connected to receive power from the first oscillator and which function to furnish a substantially constant direct voltage between the output of the microchannel plate and the screen;

second voltage multiplier means connected to receive power from the first oscillator and which function to furnish a substantially constant minimum direct voltage $V_{20}$ between the input and the output of the microchannel plate;

a second oscillator;

a sawtooth generator controlled by the second oscillator;

a pulse generator controlled by the sawtooth generator;

chopper means which function to energize the photocathode, which chopper means include: third voltage multiplier means; a field effect transistor having a source, a drain, and a base, said source and said drain being connected to shunt the third voltage multiplier means; the base being controlled by the pulse generator.

12. A power supply device as claimed in claim 11 wherein the chopper means function to continuously energize the photocathode with a chopped voltage and further comprising means which transform, rectify and smooth said chopped voltage to produce a voltage $V_{21}$ and to superimpose said voltage $V_{21}$ on the voltage $V_{20}$ supplied by the second multiplier means.

* * * * *